US009752353B2

(12) United States Patent
Matthews et al.

(10) Patent No.: US 9,752,353 B2
(45) Date of Patent: Sep. 5, 2017

(54) RECEPTACLE LOCKING DEVICE

(71) Applicant: United States Postal Service, Washington, DC (US)

(72) Inventors: James Edmund Matthews, Bowie, MD (US); Joram Shenhar, Fairfax, VA (US); Terry Martin Gingell, Spotsylvania, VA (US); Donald Eugene Irwin, Fredericksburg, VA (US); William Albert Tartal, Baltimore, MD (US)

(73) Assignee: United States Postal Service, Washington, DC (US)

( * ) Notice: Subject to any disclaimer, the term of this patent is extended or adjusted under 35 U.S.C. 154(b) by 3 days.

(21) Appl. No.: 14/788,650

(22) Filed: Jun. 30, 2015

(65) Prior Publication Data

US 2016/0000249 A1 Jan. 7, 2016

Related U.S. Application Data

(60) Provisional application No. 62/020,290, filed on Jul. 2, 2014.

(51) Int. Cl.

| | |
|---|---|
| ***E05B 65/08*** | (2006.01) |
| ***A47G 29/124*** | (2006.01) |
| ***E05C 19/18*** | (2006.01) |
| ***E05B 65/00*** | (2006.01) |

(52) U.S. Cl.

CPC ..... *E05B 65/0888* (2013.01); *A47G 29/1245* (2013.01); *E05B 65/0071* (2013.01); *E05B 65/0894* (2013.01); *E05C 19/18* (2013.01); *E05C 19/184* (2013.01)

(58) Field of Classification Search

CPC ..... E05B 65/00; E05B 65/0071; E05B 65/08; E05B 65/0864; E05B 65/0888; E05B 65/0894; E05C 19/18; E05C 19/184; E05C 19/186; E05C 19/188

See application file for complete search history.

(56) References Cited

U.S. PATENT DOCUMENTS

| | | | | | |
|---|---|---|---|---|---|
| 109,330 | A * | 11/1870 | Maddox | B63B 19/24 | 114/203 |
| 4,318,559 | A * | 3/1982 | Burton | E05B 65/0888 | 292/263 |
| 4,409,804 | A * | 10/1983 | Sork | B62H 5/12 | 70/14 |
| 4,493,501 | A * | 1/1985 | Abel | E05B 65/0888 | 292/263 |
| 4,572,557 | A * | 2/1986 | Taylor | E05B 65/0888 | 292/263 |
| 4,996,855 | A * | 3/1991 | Havenga | B60D 1/60 | 70/14 |
| 5,294,159 | A * | 3/1994 | Corrigan | E05B 65/0888 | 292/258 |

(Continued)

*Primary Examiner* — Christopher Boswell
(74) *Attorney, Agent, or Firm* — Knobbe Martens Olson & Bear LLP

(57) ABSTRACT

Receptacle locking devices are disclosed. A receptacle locking device having a contact arm and a pivoting feature can be pivoted from a first, unlocked position to a second, locked position, wherein the contact arm prevents opening of the receptacle door when the locking device is in the second, locked position.

12 Claims, 14 Drawing Sheets

(56) References Cited

U.S. PATENT DOCUMENTS

| | | | | |
|---|---|---|---|---|
| 5,685,582 | A * | 11/1997 | McCartney | E05B 65/0888 292/339 |
| 2006/0027798 | A1 * | 2/2006 | Winston | E05B 65/0007 256/65.01 |

* cited by examiner

RECEPTACLE LOCKING DEVICE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application claims the benefit of priority to U.S. Provisional Application No. 62/020,290, filed Jul. 2, 2014, the entire contents of which are herein incorporated by reference.

BACKGROUND

Field

This application relates to the field of locking devices which prevent access to a lockable volume or a receptacle.

Description of the Related Art

Collection receptacles can be used for receiving items deposited therein. The receptacles can be available to the public, such as a mail box on a street corner or other type of item receiving receptacle. In some cases, the collection receptacle is not easily lockable. However, when the owner of the receptacle wishes to prevent access to the receptacle, a locking device is needed to securely lock the receptacle and prevent access to the receptacle to prevent either deposit or removal of items from the receptacle.

SUMMARY

One aspect of the present disclosure relates to a locking device comprising a frame; a contact arm connected to an upper portion of the frame; a pair of locking arms pivotably connected to a lower portion of the frame, wherein the locking arms pivot to rotate the proximal ends of each of the pair of locking arms into alignment with each other; a locking sleeve slidably connected to a first one of the pair of locking arms, the locking sleeve configured to slide to partially surround the second of the pair of locking arms when the proximal ends of the pair of locking arms is aligned.

In some embodiments, the locking sleeve has a throughhole therein, and the second of the pair of locking arms has a throughhole therein.

In some embodiments, the throughhole formed in the locking sleeve and the throughhole in the second of the pair of locking arms are aligned when the locking sleeve is partially surrounding the second of the pair of locking arms.

In some embodiments, the throughholes formed in the locking sleeve and the second of the pair of locking arms are configured to receive at least a portion of a lock, wherein the portion of the lock inserted into the throughholes formed in the locking sleeve and the second of the pair of locking arms prevents movement of the pair of locking arms relative to each other.

In some embodiments, the pair of locking arms have bumpers connected to distal ends thereof.

In another aspect, a locking device comprises an upper frame; a lower frame pivotably connected to the upper frame; an upper arm connected to the upper frame; a lower arm connected to the lower frame; and wherein the pivotable connection between the upper frame and the lower frame is configured to allow movement of the frame between a first position and a second position, wherein, in the first position, the upper arm and the lower arm are positioned near one another, and in the second position, the upper arm and the lower arm are positioned away from one another.

In some embodiments, the locking device further comprises a locking portion, the locking portion comprising a first locking mount connected to the lower frame.

In some embodiments, the locking portion further comprises a second locking mount connected to the upper frame.

In some embodiments, the upper frame is formed with a space therein to receive the first locking mount when the locking device is pivoted to the second position.

In some embodiments, the second locking mount at least partially surrounds the space formed in the upper frame.

In some embodiments, the first locking mount is formed with a hole formed therein and the second locking mount is formed with a hole therein, and wherein the first and second locking mounts align the holes formed therein when the locking device is in the second position.

Figure 1:
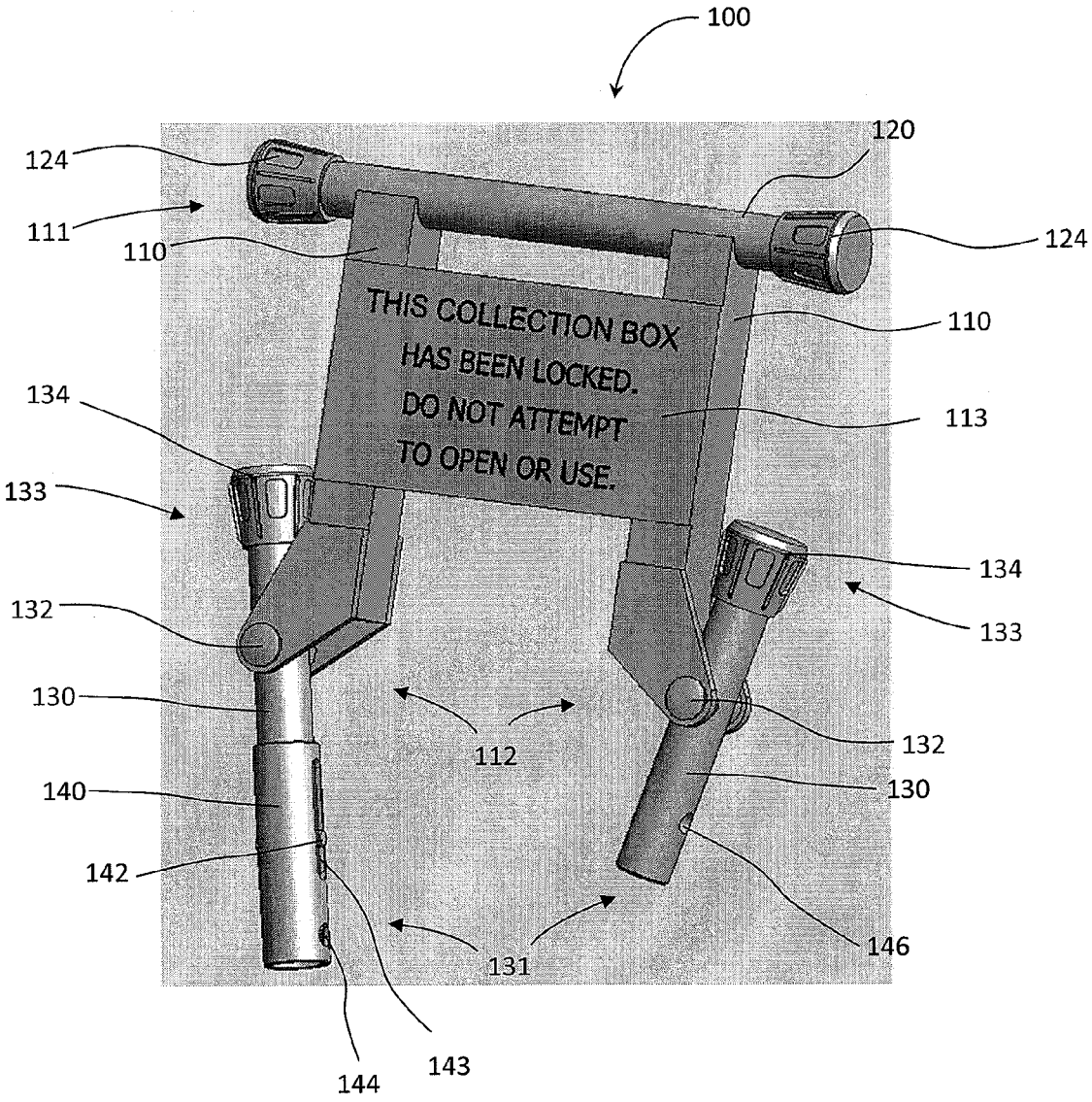
FIG. 1 depicts a perspective view of an embodiment of a locking device.

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein and as illustrated in the figures, can be arranged, substituted, combined and designed in a wide variety of configurations, all of which are explicitly contemplated and made part of this disclosure.

Some embodiments disclosed herein relate generally to a locking device. The locking device can be configured to secure a lockable volume, such as a collection box or receptacle. In some embodiments, for example, the locking device is not connected to the lockable volume or receptacle. In some embodiments, the locking device can be connected to or attached to the receptacle. The locking device can be removably attached or inserted into to the lockable volume or receptacle. In some embodiments, the locking device is used to secure a collection box or receptacle in a locked configuration. In some embodiments, the locking device is used to lock or prevent access to a mailbox or mail collection receptacle such as those used, operated, or owned by the United States Postal Service (USPS).

FIG. 1 depicts a perspective view of an embodiment of a locking device. A locking device 100 comprises a frame 110, a contact bar 120 attached or connected to the frame 110, a pair of locking arms 130, pivotably attached to the frame 110, and a locking sleeve 140.

The frame 110 is a rigid frame, constructed of a durable material suitable for locking applications. In some embodiments, the frame 110 is constructed of aluminum, steel, high density plastic, or other similar rigid, high strength material. In some embodiments, the frame comprises two parallel portions connected by a central, or connecting portion. The frame 110 may comprise a built in or attached plate 113 which can display a message to a user of the collection receptacle on which the locking device 100 is installed. In some embodiments, the plate 113 is a connecting portion, connecting the two parallel portions of the frame 110. In some embodiments, the message can be engraved directly into frame 110. The frame 110 is sized and shaped according to the locking application for which the locking device 100 is to be used, i.e., according to the size of the opening of the receptacle or the type of the receptacle. The receptacle will be described in greater detail below.

The contact bar 120 is connected to an upper portion 111 of the frame 110. The contact bar 120 can be welded, riveted, brazed, soldered, or otherwise connected to the frame 110. In some embodiments, the contact bar 120 and the frame 110 can be molded, forged, or otherwise constructed out of a single piece. The contact bar 120 can be constructed of aluminum, steel, high density plastic, or other similar rigid, high strength material. In some embodiments, the contact bar 120 is formed of the same material as the frame 110. The contact bar 120 is sized and configured to make contact with a portion of a receptacle, such as a door, roof portion, or other desired portion of the receptacle. When the locking device 110 is installed on the receptacle, the contact bar 120 prevents movement of the door of the receptacle, effectively locking shut the receptacle, as will be described in greater detail below. In some embodiments, upper bumpers 124 can be connected to the ends of the contact bar 120. The upper bumpers 124 on the contact bar 120 can be made of rubber, metal, plastic, or other material. The upper bumpers 124 can be made of an elastically deformable material to account for variations in dimensions of receptacles for which the locking device is to be used, and to enable a firm or tight friction fit in an opening of the receptacle.

In one embodiment, the locking arms 130 are rigid pieces, and may be formed of similar materials as the frame 111 and the contact arm 120. The locking arms 130 are pivotably connected at a pivot 132 to a lower portion 112 of the frame 110. The lower portion 112 of the frame 110 extends outwardly from the frame 110 so as to connect to the frame 110 at the pivot 132, which allows the locking arms 130 to rotate into a position where a bumper 134 of each of the locking arms 130 abuts a side of the frame 110, and the locking arm 130 extends downward parallel to the side of the frame 110. The locking arms 130 may be cylindrical, or rectangular, or have a circular, square, rectangular, elliptical, triangular, or diamond shaped cross-section. The locking arms 130 may be of any desired shape. The pivot 132 can be a hinge pin, a pivoting rivet, or any other desired pivotable attachment device known in the art. The pivot 132 allows the locking arms 130 to pivot so that first ends 131 of each of the locking arms 130 can be brought into close proximity with each other and/or moved away from each other. The locking arms 130 also include upper bumpers 134 attached or connected to second ends 133 of the locking arms 130. The upper bumpers 134 can be made of rubber, metal, plastic, or other material. The upper bumpers 134 can be made of an elastically deformable material to account for variations in dimensions of receptacles for which the locking device is to be used, and to enable a firm or tight friction fit in an opening of the receptacle. As will be described in greater detail below, the locking arms 130 are rotatable about pivot 132, to rotate the upper bumpers 134 to impinge against internal surfaces of a receptacle, and to hold the locking device 100 in place.

In one embodiment, the locking sleeve 140 is a rigid sleeve, slidably connected to one of the locking arms 130. The locking sleeve 140 can be formed of a material similar to the frame 110 and the contact bar 120 described above. The locking sleeve 140 has a groove or slot 143 formed therein, the groove or slot 143 is formed in the sleeve along a portion of the length of locking sleeve 140. Where the locking arms 130 are cylindrical, the locking sleeve 140 is a hollow cylindrical sleeve. In embodiments where the locking arms 130 are not cylindrical, the locking sleeve 140 can be correspondingly shaped or sized in order to surround and slide along the locking arms 130, with the locking arms 130 extending within the locking sleeve 140.

The locking arm 130 on which the locking sleeve 140 is positioned also has a post 142 which protrudes perpendicularly from the surface of the locking arm 130. The post 142 is positioned on the locking arm 130 such that the post 142 extends into and through the groove or slot 143 formed in the locking sleeve 140. The post 142 may extend in one direction away from the locking arm 130, or may extend in two opposite directions from the locking arm 130, into corresponding grooves 143 formed in opposite sides of the locking sleeve 140. The locking sleeve 140 moves or slides along the locking arm 130 to the extent allowed by the post 142. As the post extends through the groove or slot 143 in the locking sleeve 140, the locking sleeve 140 is unable to slide beyond a point at which an inner surface of the groove or slot 143 impinges on a surface of the post 142.

The locking sleeve 140 and post 142 are connected to one of the locking arms 130 such that when ends 131 of the locking arms 130 are brought into proximity, the locking sleeve 140 can slide along one locking arm 130 and at least partially onto the other locking arm 130, surrounding a portion of the other locking arm 130. The travel of the locking sleeve 140 is limited by the post 142.

The locking sleeve 140 has a first locking hole 144 formed therein. The first locking hole 144 is formed at a position on the locking sleeve 140 toward the first end 131 of the locking arm 130 on which the locking sleeve 140 is positioned. The first locking hole 144 can extend through the locking sleeve 140, resulting in two holes in the locking sleeve 140 positioned directly opposite one another.

The locking arm 130 on which the locking sleeve 140 is not positioned has a second locking hole 146 formed therein. The second locking hole 146 can extend entirely through the locking arm 130. The first and second locking holes 144 and 146 can be formed through the locking sleeve 140 and the locking arm 130, respectively, in a direction perpendicular to the length of the locking sleeve 140 and the locking arms 130. The first locking hole 144 and the second locking hole 146 are positioned such that when the locking sleeve 140 is moved or extended from one locking arm 130 and partially onto the other locking arm 130, the first and second locking holes 144 and 146 are aligned, such that a lock (not shown) can be positioned through the first and second locking holes 144 and 146. The lock can be a padlock, keyed lock, locking bar, or other desired locking device. When the lock is inserted into the first and second locking holes 144 and 146, the locking sleeve 140 is held in place by the lock, and the locking arms 130 are maintained in position, as will be described in greater detail below.

Figure 2:
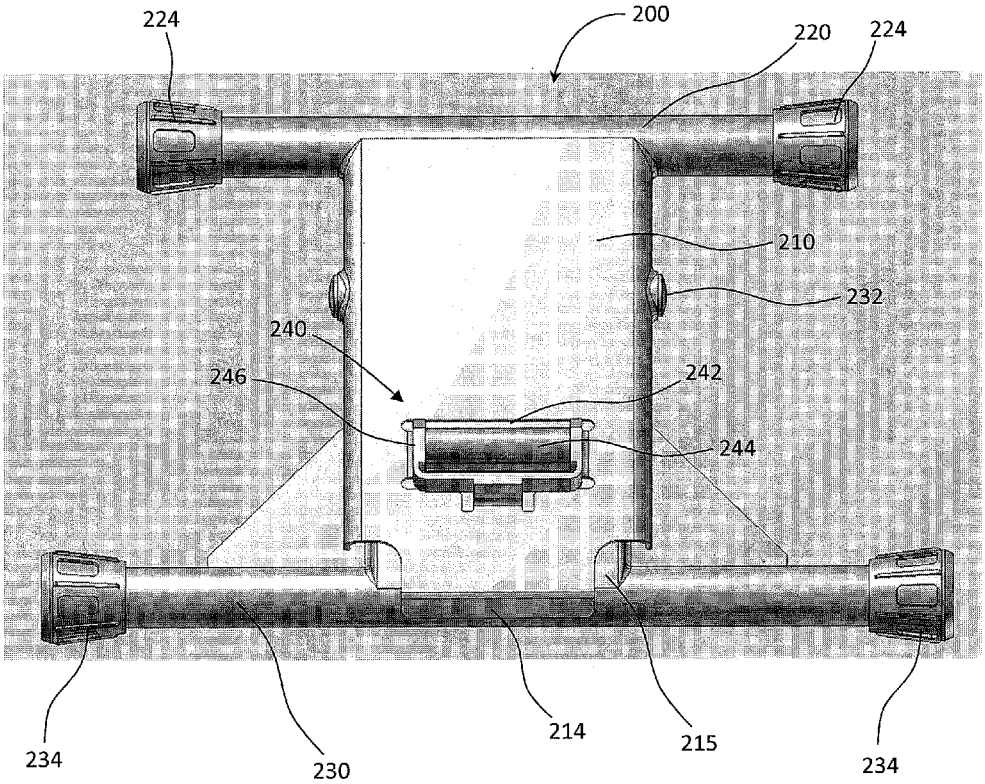
FIG. 2 depicts a front view of another embodiment of a locking device.

FIG. 2 depicts a front view of another embodiment of a locking device. A locking device 200 comprises an upper frame 210, a lower frame 215, an upper arm 220, a lower arm 230, and a lock portion 240.

The upper frame 210 and the lower frame 215 are rigid frames, constructed of a durable material suitable for locking applications. In some embodiments, the upper frame 210 and the lower frame 215 are constructed of aluminum, steel, high density plastic, or other similar rigid, high strength material. In addition, the other components of the locking device may be made of material or constructed similar to the upper frame 210 and the lower frame 215. The upper frame 210 and/or the lower frame 215 may include a plate (not shown) which can display a text, symbol, or other message to a user of the collection receptacle on which the locking device 200 is installed. The upper frame 210 and the lower frame 215 are sized and shaped according to the locking application, i.e., according to the size of the opening of the receptacle or the type of the receptacle for which the locking device 200 is to be used. The receptacle will be described in greater detail below.

The upper frame 210 is connected to the upper arm 220. The upper arm 220 may be attached by a weld, rivet, screw, glue, or any other attachment method known in the art. In some embodiments, the upper frame 210 and the upper arm 220 are formed of a single, integral piece, such as by forging, molding, or other similar forming method known in the art.

The lower frame 215 is connected to the lower arm 230 similar to the connection methods described with regard to the upper frame 210 and upper arm 220. The upper frame 210 and the lower frame 215 are hingedly attached at a hinge or a pivot 232. The pivot 232 allows the upper frame 210 and the lower frame 215 to move relative to each other. Rotation about the pivot 232 moves the upper arm 220 and the lower arm 230 toward and away from one another, while maintaining the upper arm 220 parallel to the lower arm 230. Movement about the pivot 232 will be described in greater detail below. In some embodiments, the upper arm 220 is shorter than the lower arm 230, in order to facilitate installation of the locking device 200.

The upper arm 220 has upper bumpers 224 connected on the ends thereof, and the lower arm 230 has lower bumpers 234 connected on the end thereof. The upper and lower bumpers 224 and 234 can be similar to bumpers described elsewhere herein. The upper and lower bumpers 224 and 234 are configured and positioned to impact surfaces of the receptacle on which the locking device 200 is installed in order to maintain the locking device 200 in position, and prevent or minimize damage to the receptacle.

The lock portion 240 includes a first locking hole mount 244 and a second locking hole mount 246. The first locking hole mount 244 can be formed as a raised surface connected to the lower frame 215, extending upward, perpendicular to the plane of the lower frame 215. The first locking hole mount 244 is formed with a hole (not shown) running therethrough. The hole runs through the first locking hole mount 244 parallel to the surface of the lower frame 215, and perpendicular to the upward extending direction of the first locking hole mount 244. The hole is sized and positioned to receive a lock, such as a padlock, locking bar, or other lock known in the art. The first locking hole mount 244 is positioned on the lower frame 215 so as to extend through a space 242 in the upper frame 215 when the upper and lower frames 210 and 215 are moved from a first, unlocked position, into a second, locked position, which will be shown below. FIG. 2 illustrates the locking device in the second, or locked position.

Although the first locking hole mount 244 and the space 242 are depicted as generally rectangular, one of skill in the art would understand that the first locking hole mount 244 and the space 242 may be of any desired, corresponding shape, without departing from the scope of the disclosure.

The second locking hole mount 246 extends perpendicularly from the surface of the upper frame 210, and surrounds the space 242 on at least two opposing sides. In some embodiments, the second locking hole mount 246 surrounds the space 242 on three sides, or completely surrounds the space 242. As described above, the space 242 may be of any desired shape, and the second locking hole mount 246 can be shaped to correspond to the shape of the space 242. The second locking hole mount 246 can be a raised rail, edge, or ridge partially or completely surrounding the space 242. The second locking hole mount 246 can have throughholes formed in opposite sides thereof. For example, the second locking hole mount 246 can be a ridge surrounding three sides of the space 242, with a hole formed in opposing surfaces of the ridge, with the holes aligned with each other to receive a lock (not shown).

The hole (not shown) of the first locking hole mount 244 is positioned to align with the holes of the second locking hole mount 246. This provides for a locking channel to receive a lock, when the locking device 200 is in the second, locked position. When the locking device 200 is in the second, locked position, the holes in the first locking hole mount 244 align with the holes of the second locking hole mount 246 so as to receive a lock therethrough.

The upper frame 210 also includes a handle 214. The handle 214 can extend beyond the lower arm 230, and in some embodiments, can follow the contour of the lower arm 230 to enable a friction, or snap fit between the handle 214 and the lower arm 230 when the locking device 200 is in the second, locked position. The handle 214 may also comprise a surface which extends from the upper frame 210, which can be grasped or held by an operator during installation of the locking device 200, and can be pushed or pulled to manipulate the locking device 200 about the pivot 232.

Figure 3:
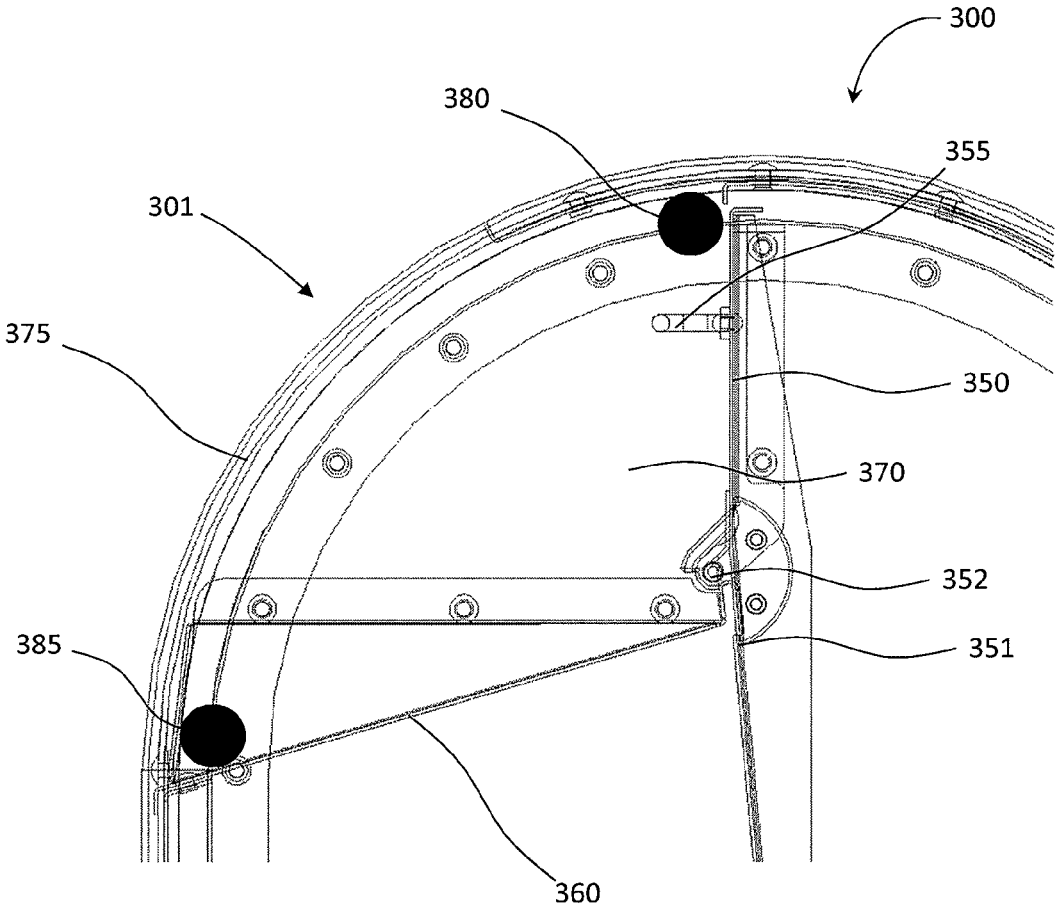
FIG. 3 depicts a see-through side view of an embodiment of a receptacle.

FIG. 3 depicts a see-through side view of an embodiment of a receptacle for which a locking device can be used. The receptacle pictured here is similar to the standard mail collection boxes used, owned and operated by the USPS. However, a person of skill in the art would understand that other receptacles can be used with locking devices as described herein without departing from the scope of the present disclosure. The receptacle 300 comprises an opening area 301, a door 350, a floor 360, and one or more sides 370. The opening area 301 is an area of the receptacle which is an open volume bounded by sides 370, the door 350, the floor 360, and a roof (not shown). The opening area 301 provides a volume for receiving the door 350 as the door 350 moves, so that a user may deposit an item into the receptacle via the door 350.

The door 350 is connected to the receptacle frame 351 via a hinge 352. The hinge 352 provides for the door 350 to be hinged open, the door 350 sweeping into the open area 301 as the door 350 moves. The hinge 352 can be of any hinge type known in the art. The door 350 includes a handle 355 which can be grasped or operated to exert an opening force on the door 350. The floor 360 provides a boundary to the open area 301, below which the receptacle is not accessible. The floor 360 can also act as a limiter to limit the travel of the door 350 about hinge 352. As the door 350 is opened, the door 350 and the handle 355 move in an arc downward toward the floor 360. When the handle 355 or the door 350 impinges on a portion of the floor 360, the door 350 is no longer moveable in that direction. In some embodiments, the hinge 352 may provide a travel limiter for the door 350.

The sides 370 border the open area and are themselves bounded by edges 375. The sides may be impervious, rigid or semi-rigid. The sides 370 may have flat, planar surfaces. In some embodiments, the sides 370 may be disposed in parallel planes apart from each other, separated by the opening area 301, such that the opening area 301 has a constant width defined by the sides 370. In some embodiments, the opening area 301 may have a changing width, such as a tapering width, that changes as the sides 370 angle inward, indent, or extend outward.

In FIG. 3, the sides 370 and the edges 375 are shown as being transparent for ease of description. The edges 375 may include a lip (not shown) which extends from a portion of the sides 370, inward into the opening area 301. The inwardly extending lip may reduce the width of a portion of the opening area 301, as seen from the front of the receptacle 300, beyond that of the sides 370.

An upper contact point 380 and a lower contact point 385 are depicted as black circles. The upper and lower contact points 380 and 385 show where the upper and lower bumpers 224 and 234 of the locking devices described above are positioned when the locking devices 100 or 200 are installed in the receptacle 300, but are not physical features of the receptacle 300. In some embodiments, the upper contact point 380 depicts where the upper arm 220, or the contact bar 120 may be positioned. In some embodiments, the locking device 100 or 200 may not make actual contact with the sides 370 at the upper contact point 380, such as, for example, where the upper arm 220 of the locking device 200 is shorter than the lower arm 230.

The upper contact point 380 also depicts a point at which the locking device 100 or 200, when in a locked position, makes contact with the door 350. In some embodiments, the locking device makes contact with the door 350 at the upper contact point 380. In some embodiments, the locking device is not in contact with the door 350 at the upper contact point 380, but is positioned near the door 350, such that the door can move a small amount about hinge 352 when a user attempts to open the door 350. In this case, after a small amount of movement, the door 350 will impinge on the locking device at contact point 380, to prevent further movement of the door 350, and to preclude access to the receptacle.

The lower contact point 385 depicts where the locking arms 130 or the lower arm 230 of the locking device 100 or 200 makes contact with the sides 370 and or the lip (not shown) of the receptacle when the locking device is in the second, locked position. In some embodiments, the locking device 100 or 200 contacts the floor 360 at or near the lower contact point 385.

Figure 4A:
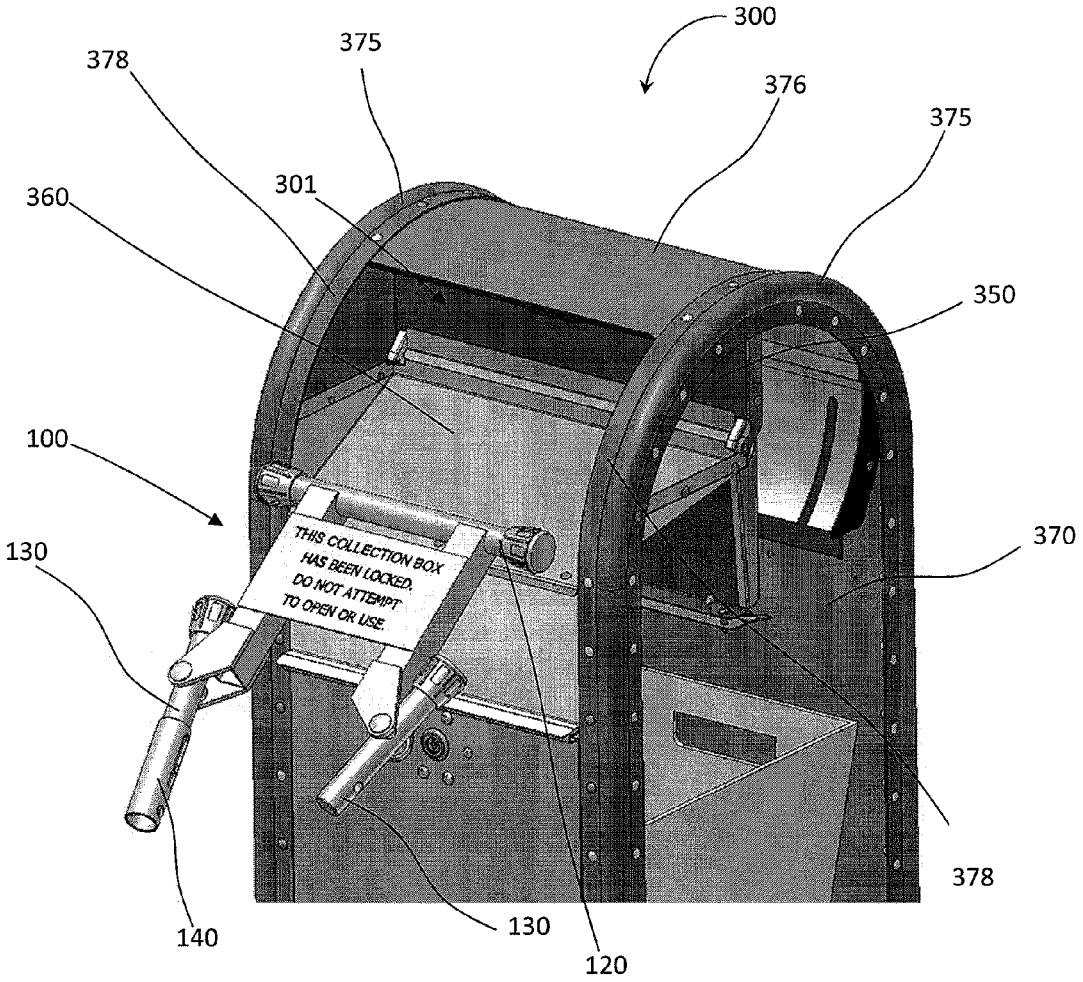
FIG. 4A depicts a perspective view of an embodiment of a locking device prepared for application to a receptacle.

FIG. 4A depicts an embodiment of a locking device 100 prepared for installation on or in a receptacle 300, with the lock arms 130 in a first, unlocked position. In FIG. 4, the locking device 100 is positioned outside the opening area 301 of the receptacle 300. As shown, the opening area 301 is bounded by the door 350, the sides 370 (which are shown as transparent for ease of illustration), edges 375, and a roof 376. The edges 375 include a lip 378, which extends into the opening area 301.

Prior to insertion of the locking device 100 into the opening area 301, the lock arms 130 are pivoted to a first, or unlocked position, as depicted in FIG. 4A, where the first ends 131 of the lock arms 130 are not in proximity to each other.

Figure 4B:
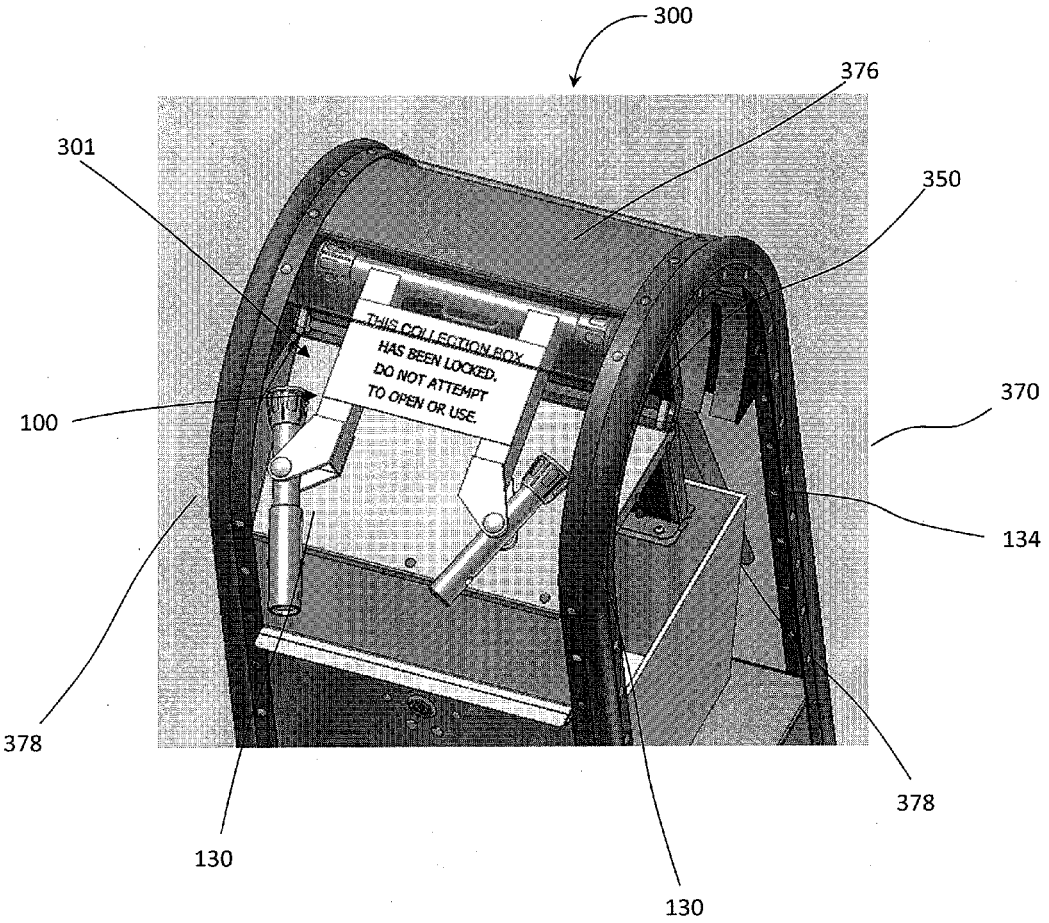
FIG. 4B depicts a perspective view of an embodiment of a locking device in an opening area of a receptacle in an intermediate unlocked position.

FIG. 4B depicts the locking device 100 inserted into the opening area 301 of the receptacle 300. As shown, the contact bar 120 is inserted into the opening area 301 to a position proximate to the door 350 and the roof 376. In some embodiments, the contact bar 120 can be advantageously positioned proximate to the door 350 and the roof 376, at a point above the handle 355. Also as shown, the lock arms 130 are rotated into an intermediate position between the first, unlocked position shown in FIG. 4A, and a second, locked position. In the intermediate position, the lock arms 130 have been rotated about pivot 132 such that the upper bumpers 134 are moved toward, or in closer proximity to, sides 370 (which are shown transparently for illustration).

Figure 4C:
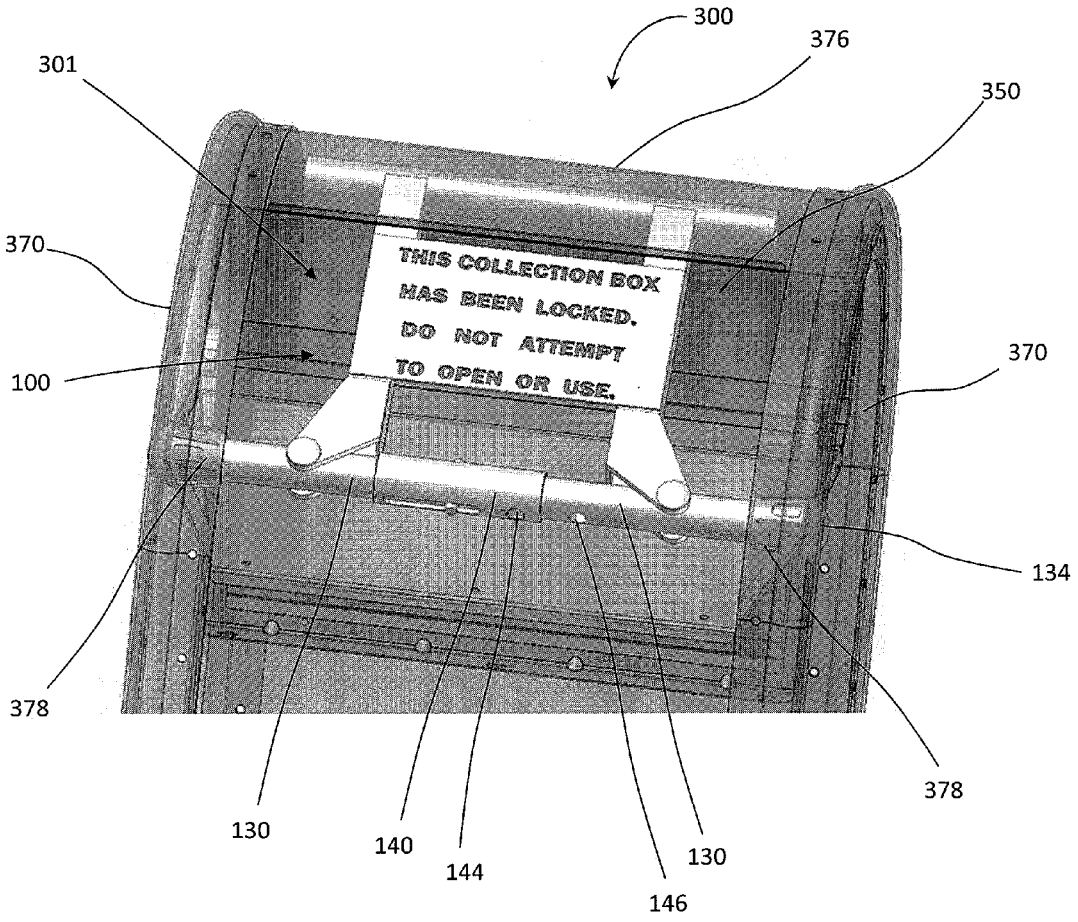
FIG. 4C depicts a perspective view of an embodiment of a locking device having lock arms in a locked position and a locking sleeve in an unlocked position.

FIG. 4C depicts the locking device 100 inserted into the opening area 301 of the receptacle 300, with the lock arms 130 in a second, locked position. In the second, locked position, the lock arms 130 are pivoted on pivot 132 such that the first ends 131 are in proximity to each other, and the upper bumpers 134 are impinging on the sides 370 of the receptacle 300. The lock arms 130 and the upper bumpers 134 are sized such that when the lock arms 130 are in the second, locked position, the bumpers impinge on the sides 370 of the receptacle, and push against the sides 370 such that the locking device 100 is held in place by a friction fit between the upper bumpers 134 and the sides 370. Where the upper bumpers 134 are made of an elastic material, the upper bumpers 134 can compress under a force applied between the lock arms 130 and the sides 370 when the lock arms 130 are rotated. The force can be sufficient to firmly hold the locking device in place within the opening area 301. Additionally, the upper bumpers 134 can contact an inner surface of the lips 378 connected to the sides 370. By having the upper bumpers 134 in contact with on the inner surface of the lips 378, the locking device 100 is prevented from being withdrawn from the opening area 301 with the lock arms 130 in the second, locked position.

FIG. 4C also depicts the locking sleeve 140 in an unlocked position, with the locking sleeve located mostly on the lock arm 130 to which the locking sleeve 140 is connected. Also, with the locking sleeve in the unlocked position, the first locking hole 144 is not aligned with the second locking hole 146. With the locking sleeve 140 in the unlocked position, the lock arms are freely pivotable about pivot 132. To remove the locking device from the opening area 301, the lock arms 130 may be pivoted to the first, unlocked position, and the locking device 100 may be removed.

Figure 4D:
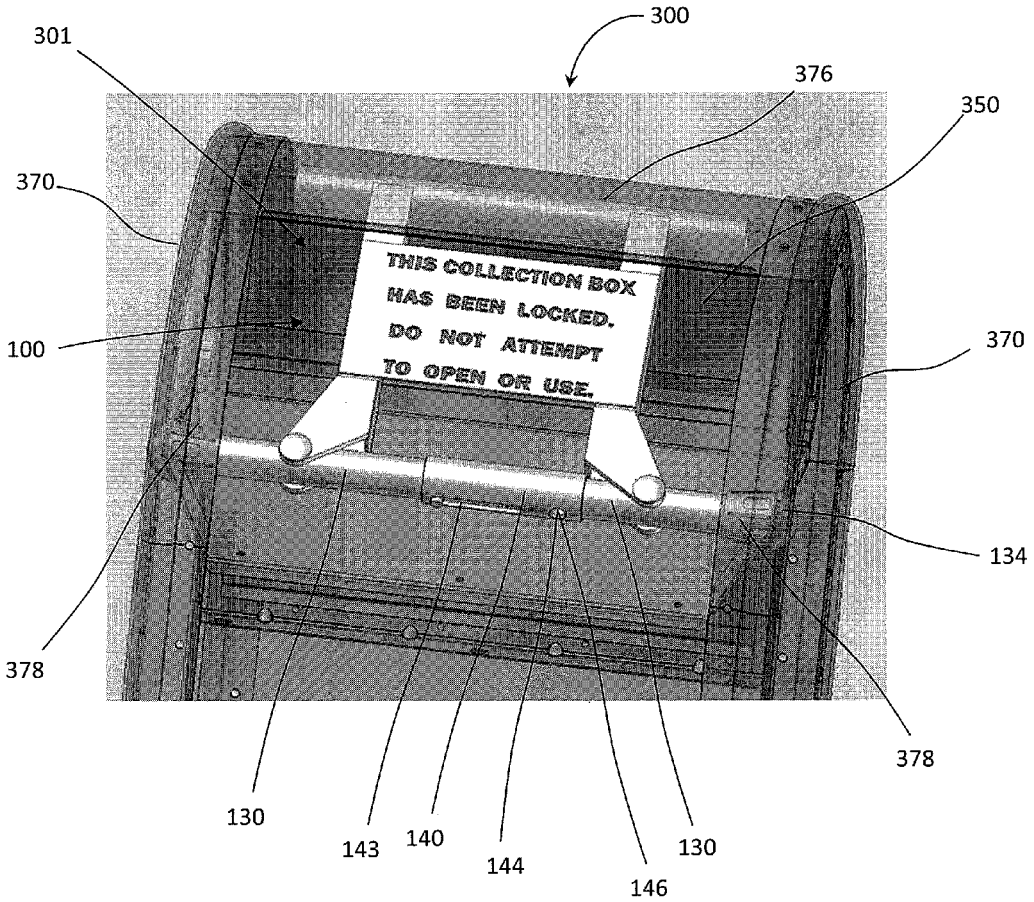
FIG. 4D depicts a perspective view of an embodiment of a locking device having lock arms in a locked position and a locking sleeve in a locked position.

FIG. 4D depicts the locking device 100 inserted into the opening area 301 of the receptacle 300, with the lock arms 130 in a second, locked position, and the locking sleeve 140 in a locked position. The edge 375, the roof 376, and the lips 378 are shown transparent in FIG. 4D for ease of illustration.

In the locked position, the locking sleeve 140 is extended from the lock arm 130 to which it is connected, and surrounds the other lock arm 130. The post 142 prevents further travel of the locking sleeve 140 by contacting the groove or slot 143 in the locking sleeve 140. With the locking sleeve 140 in the locked position, the first lock hole 144 and the second locking hole 146 are aligned.

Figure 4E:
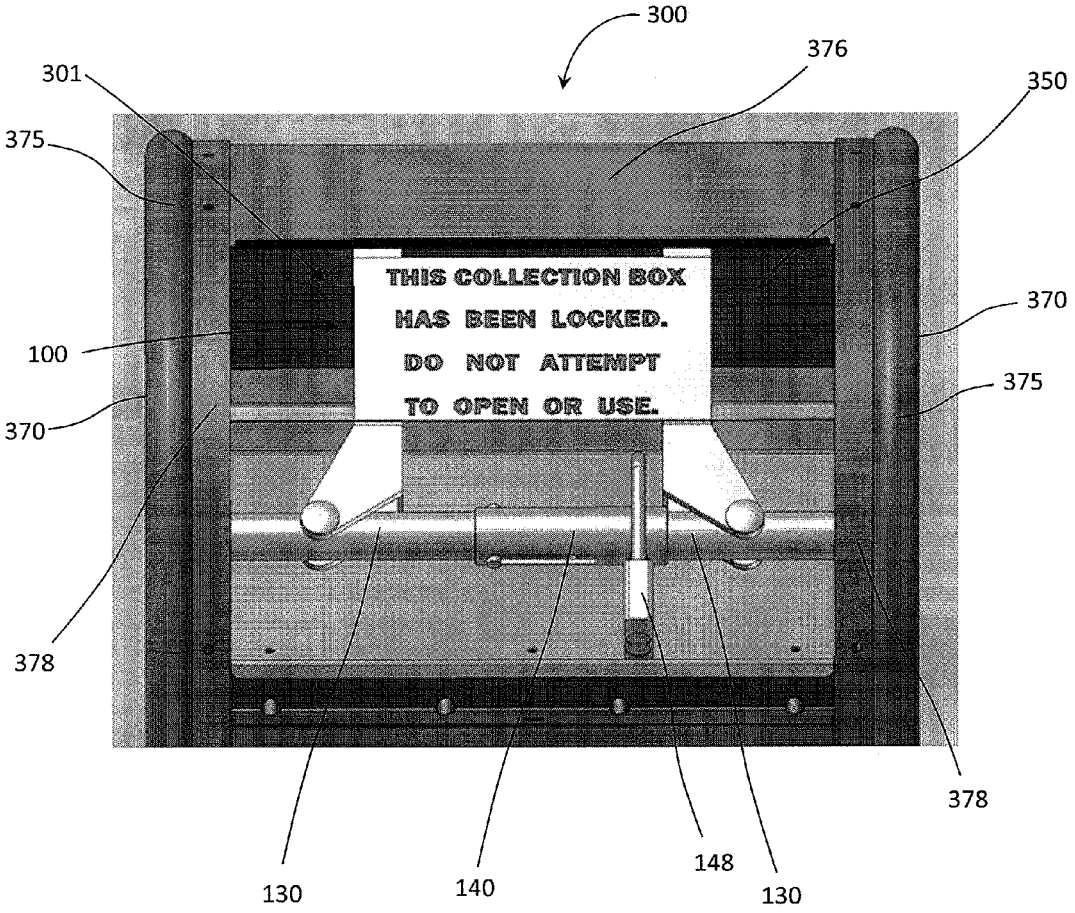
FIG. 4E depicts a perspective view of an embodiment of a locking device in a locked position installed on a receptacle.

FIG. 4E depicts the locking device 100 having a lock 148 inserted through the aligned first and second locking holes 144 and 146. With the lock 148 inserted, the locking sleeve cannot slide along the lock arms 130, and is held in position by the lock 148. Thus, the lock arms 130 cannot be pivoted, due to the locking sleeve 140 constraining their position. In this way, the locking device 100 cannot be removed from the opening area 301, because the upper bumpers 134 (not shown in FIG. 4E) impinge on the inner surface of the lips 378, unless the lock 148 is removed. The lock 148 can be operated by a key or combination, and can be of any desired lock known in the art. The key or combination to operate the lock can be held or known only by the owner or provider of the receptacle 300, thus controlling access to the receptacle 300.

To use the locking device 100, an operator or user inserts the locking device 100 into the opening area 301, positioning the contact bar 120 against, or in close proximity to, the door 350 and the roof 376. The operator or user then rotates the lock arms 130 into the locked position, applying force, if necessary, to compress the upper bumpers 134 against the sides 370. Once the lock arms are in the locked position, the operator or user slides the locking sleeve 140 onto the lock arm 130 to which the locking sleeve is not connected, and aligns the first and second locking holes 144 and 146. Once the first and second locking holes 144 and 146 are aligned, the operator or user inserts a lock 148 into the first and second locking holes 144 and 146, thereby securing the locking device 100 in the opening area 301, and preventing use of the door 350.

To remove the locking device, the operator or user must use a key, combination, code, or similar device to operate the lock 148, and unlock the lock 148. Once the lock 148 is unlocked, the lock 148 can be removed from the first and second locking holes 144 and 146. With the lock 148 removed, the operator or user slides the locking sleeve 140 until the locking sleeve impinges on the post 142, or until the locking sleeve 140 no longer encloses or surrounds the lock arm 130 to which the locking sleeve 140 is not attached. The lock arms 130 may then be pivoted to move the first ends 131 of the lock arms 130 away from each other, and the locking device 100 may be removed from the opening area 301.

Figure 5A:
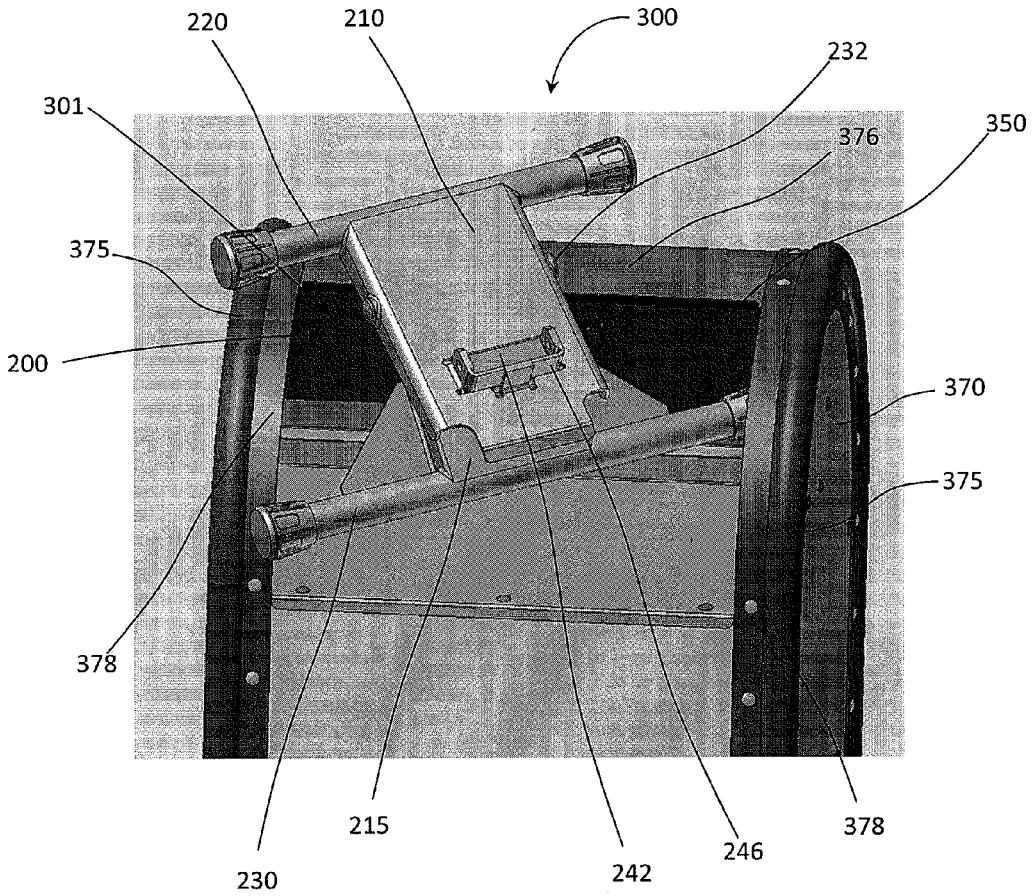
FIG. 5A depicts a perspective view of another embodiment of a locking device partially inserted into an opening area of a receptacle.

FIG. 5A depicts the locking device 200 partially inserted into the opening area 301 of receptacle 300. The locking device 200 is shown in a first, or unlocked position, wherein the upper frame 210 is rotated away from the lower frame 215 via the pivot 232. As depicted, one bumper 234 on one end of lower contact arm 230 can be inserted into the opening area first 301 to get around the lip 378.

Figure 5B:
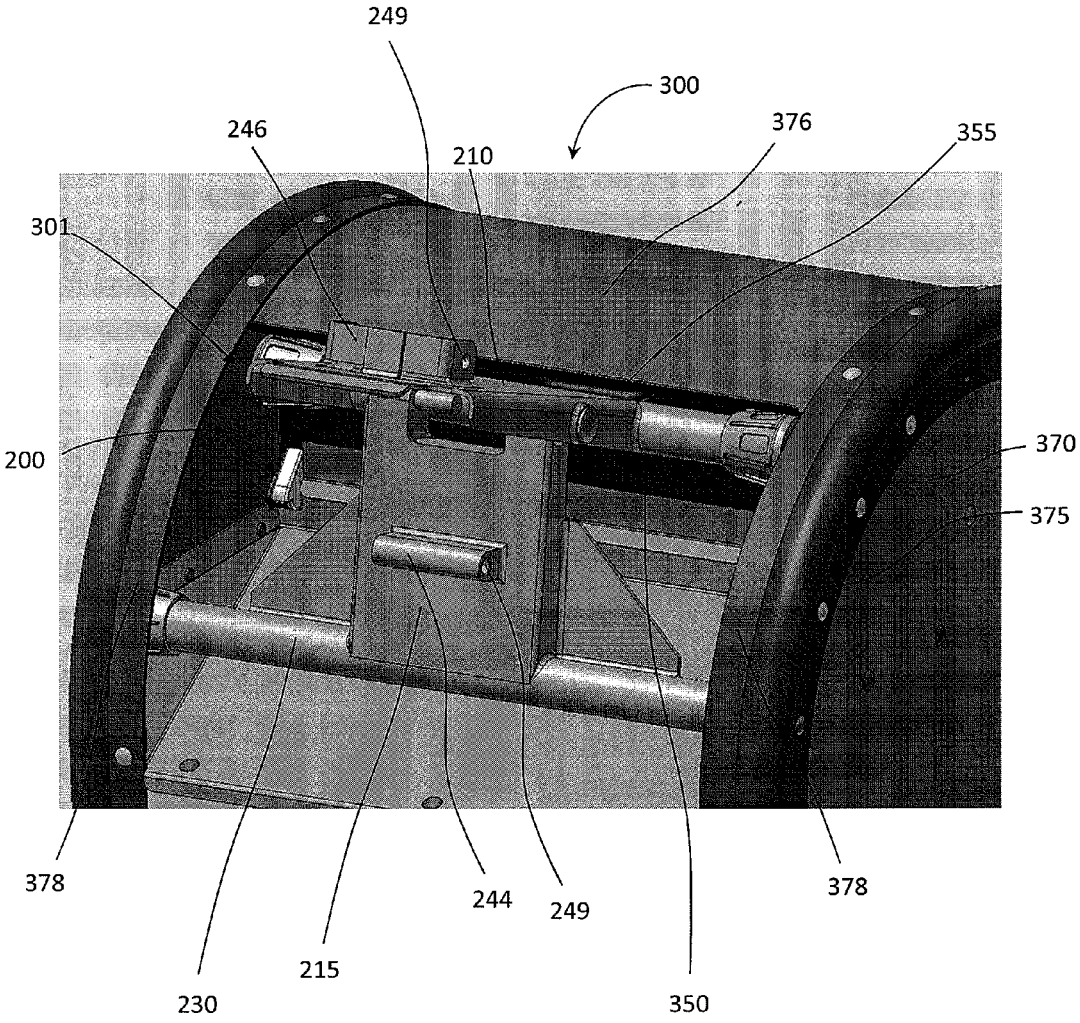
FIG. 5B depicts a perspective view of another embodiment of a locking device inserted into the opening area of the receptacle in an unlocked position.

FIG. 5B depicts the locking device 200 inserted into the opening area 301 of the receptacle 300. The lower bumpers 234 on the lower arm 230 are in contact with the sides 370 and/or an inner surface of the lip 378. The lower bumpers 234 on the lower arm 230 impinge on the sides 370 and/or lip 378 to provide a friction fit as described elsewhere herein. The upper frame 210 is moved away from the lower frame 215 about the pivot 232, which moves the upper arm 220 nearer the lower arm 230.

In the first, unlocked position, the locking device 200 can be fully inserted into the open area 301. By pivoting the upper frame 210 on pivot 232, the distance between the upper arm 220 and lower arm 230 of the locking device 200 can be reduced, enabling the upper arm 220 to be inserted into the opening area 301, clearing an edge of the roof 376. The upper arm 220 and/or the upper bumpers 224 can thus be positioned near, or in contact with, the roof 376 near the intersection of the roof 376 and the door 350, or with the door 350, or both. In some embodiments, the upper arm 220 can be advantageously positioned to contact the roof 376 at a point above the handle 355.

In the first, unlocked position, the first locking hole mount 244 is not within the space 242 in the upper frame 215, or near the second locking hole mount 246, as depicted in FIG. 5B.

Figure 5C:
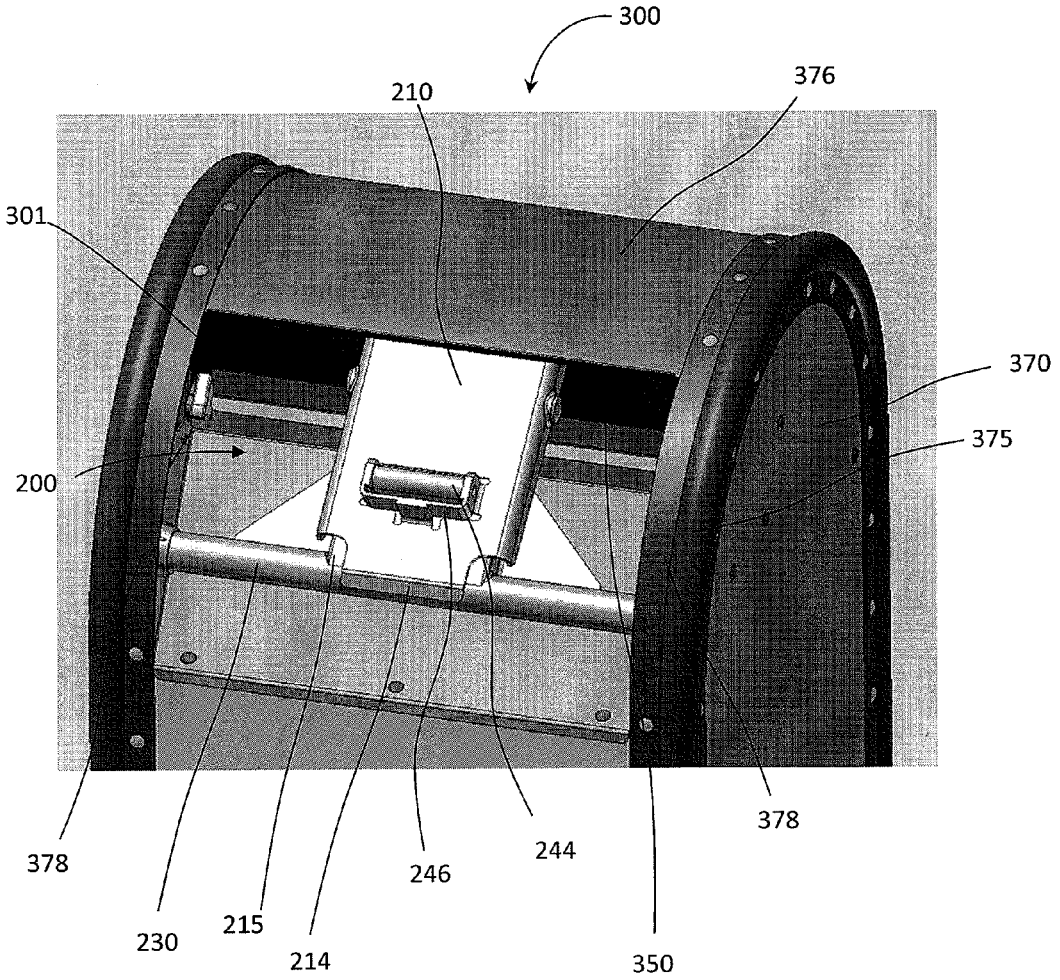
FIG. 5C depicts a perspective view of another embodiment of a locking device inserted into the opening area of the receptacle in an unlocked position.

FIG. 5C depicts the locking device 200 inserted into the opening area 301 of the receptacle 300 in a locked position. The locking device 200 is moved from a first, unlocked position to a second, locked position by rotating the upper frame 210 toward the lower frame 215, by moving the handle 246 toward the lower arm 230. Rotating the upper frame 210 in this way also moves the upper arm 220 away from the lower arm 230, and extends the height of the locking device 200. In the second, locked position, the first locking hole mount 244 is moved into the space 242 in the upper frame 210, and is positioned near the second locking hole mount 246. This aligns lock holes 249 formed in the first and second locking hole mounts 244 and 246. This also positions the upper arm 220 in contact with the door 350, the roof 376, or both, such that movement of the door 350 is limited or prevented. In the locked position, a handle 214 extends over the lower arm. The handle 214 provides a convenient gripping location when moving the locking device 200 either into or out of the locked position.

Figure 5D:
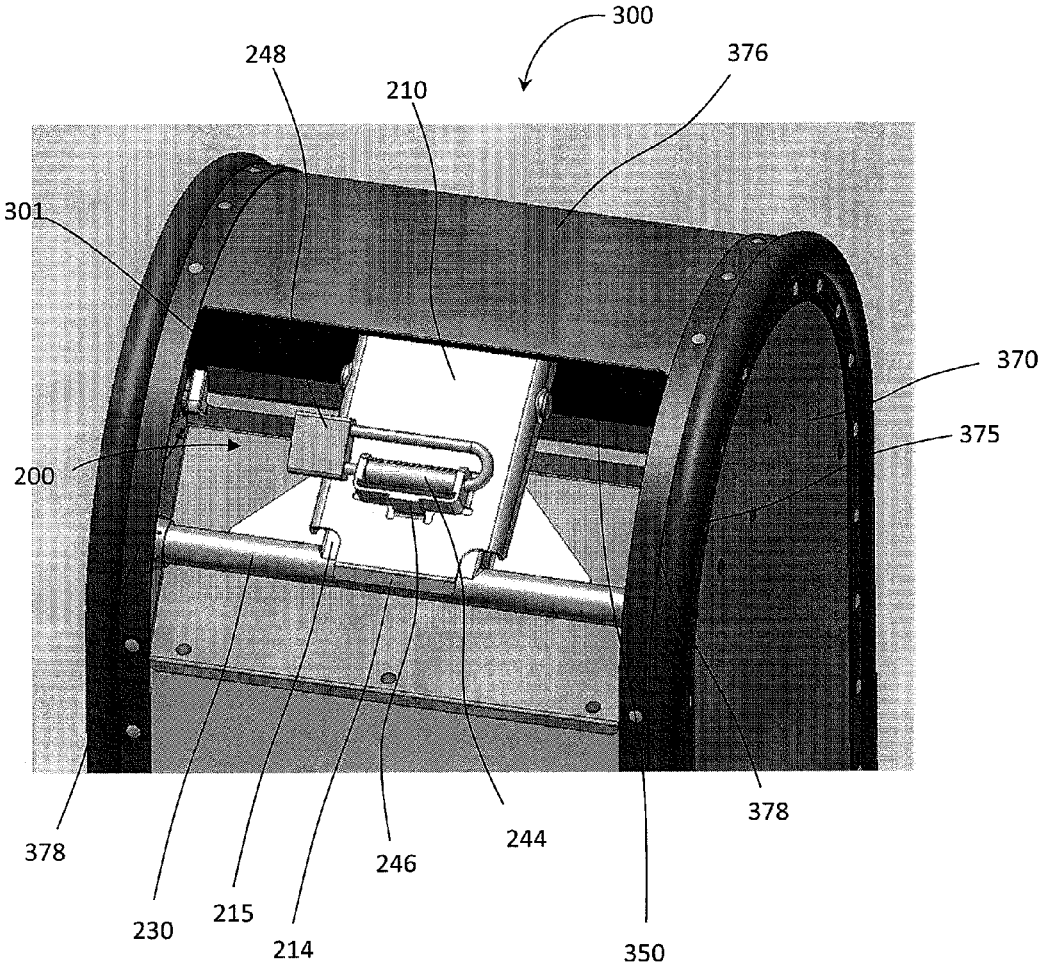
FIG. 5D depicts a perspective view of another embodiment of a locking device inserted into the opening area of the receptacle in a locked position.

FIG. 5D depicts the locking device 200 having a lock 248 inserted through the holes 249 of the first locking hole mount 244 and the second locking hole mount 246. With the lock 248 inserted through the holes 249 of the first locking hole mount 244 and the second locking hole mount 246, the first locking hole mount 244 is held in place with regard to the second locking hole mount 246, and because the first locking hole mount 244 is attached to the second frame 215, and the second locking hole mount 246 is attached to the upper frame 210, the upper frame 210 and the lower frame 215 are held fixed in relation to each other. This prevents the locking device 200 from being removed from the opening area 301, and securely prevents access to the door 350 and the receptacle 300.

The locking device 200 may be installed in an opening area 310 by the following procedure. A user can insert one end of the lower arm 230 into the opening area, at a diagonal. The other end of the lower arm 230 can then be inserted into the opening area 301, and the lower arm 230 straightened within the opening area 301. The user places the locking device 200 in the first, unlocked position by moving the handle 246 to rotate the upper frame 210 and the lower frame 215 away from one another. The user inserts the upper arm 220 into the opening area 301. With the locking device 200 in the first, unlocked position, the user moves the lower arm 215 away from the door 350, until the lower bumpers 234 impinge on the inner surfaces of the lips 376 on both ends of the lower arm 215.

Next, the upper arm 210 is positioned to be in line with, or above the handle 355. The user then moves handle 246 to move the locking device 200 into the second, locked position. Moving the locking device 200 into the second, locked position will move the upper arm 220 toward the door 350 and the roof 376. In some embodiments, the locking device 200 is designed to contact the door 350 and/or roof 376 at a point above the handle 355.

The user then inserts a lock 248 into the holes of the first locking hole mount 244 and the second locking hole mount 246. When the lock 248 is locked, the locking device 200 cannot be removed from the receptacle 300.

To remove the locking device 200, the user unlocks and removes the lock 248. The user moves the handle 246 upward, transitioning the locking device 200 into the first, unlocked position. At this point, the lower arm 230 can be moved diagonally within the opening area 301, and then removed from the opening area 301.

Figure 6A:
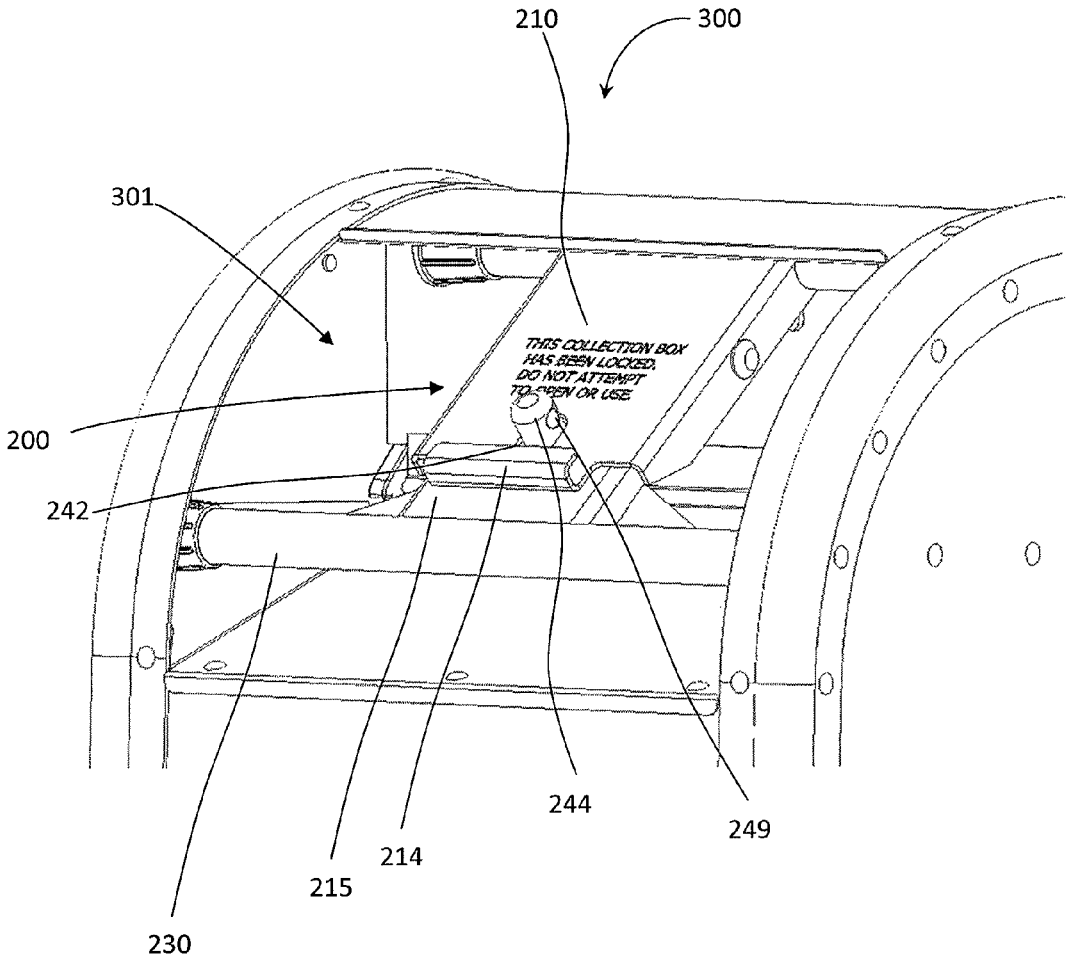
FIG. 6A depicts a partial perspective view of a portion of another embodiment of the locking device inserted into the opening area of the receptacle in a locked position.

FIG. 6A depicts an embodiment of the first locking hole mount 244 in locking device 200. The first locking hole mount 244 can be a protrusion from the lower frame 215 configured to extend through space 242 in the upper frame 210 similar to that described elsewhere herein. The space 242 is configured to receive the first locking hole mount 242, similar to that described elsewhere herein.

The first locking hole mount 244 is formed with the locking hole 249 extending therethrough in an direction parallel to the lower frame 215, and to the upper frame 210, when the locking device 200 is in its locked position.

Figure 6B:
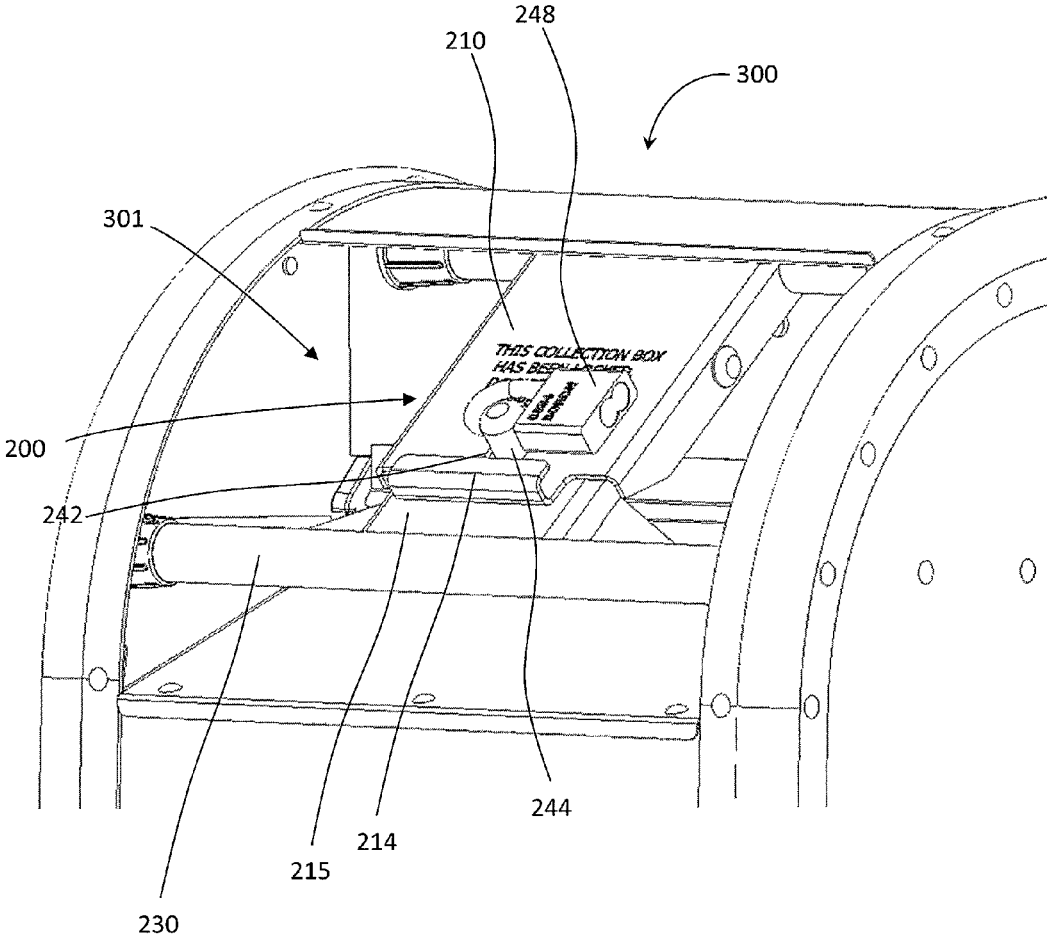
FIG. 6B depicts a partial perspective view of a portion of another embodiment of the locking device inserted into the opening area of the receptacle in a locked position with a lock applied.

FIG. 6B depicts the locking device 200 of FIG. 6A having lock 248 installed. A portion of the lock 248 extends through the locking hole 249 and beyond the edges of the space 242. The dimensions of the lock 248, in at least one direction, are larger than the dimensions of the space 242 such that, when the lock 248 is installed on the first locking hole mount 244, the first locking hole mount 244 cannot move through the space 242 due to the impingement of the lock 248 on the upper frame 210. In this way, the locking device 200 is securely locked in place, and cannot be removed unless lock 248 is removed.

Although illustrated within the context of a USPS collection mailbox, embodiments of the locking devices of the present disclosure may also be used in other applications, such as on other types of collection boxes or receptacles. It will be understood by those of skill in the art that numerous and various modifications can be made without departing from the spirit of the development. Therefore, it should be clearly understood that the forms of the development described herein are illustrative only and are not intended to limit the scope of the development.

The term "comprising" as used herein is synonymous with "including," "containing," or "characterized by," and is inclusive or open-ended and does not exclude additional, unrecited elements or method steps.

All references cited herein are incorporated herein by reference in their entirety. To the extent publications and patents or patent applications incorporated by reference contradict the disclosure contained in the specification, the specification is intended to supersede and/or take precedence over any such contradictory material.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this disclosure be limited to the specific embodiments disclosed herein, but that it cover all modifications and alternatives coming within the true scope and spirit of the disclosure as embodied in the attached claims.

What is claimed is:

1. A locking device comprising:

a frame;

a contact arm fixedly attached to a first portion of the frame, wherein the contact arm extends beyond an edge of the frame;

a pair of locking arms pivotably connected to a second portion of the frame, wherein the locking arms are pivotable to rotate proximal ends of each of the pair of locking arms into alignment with each other; and a locking sleeve slidably connected to a first one of the pair of locking arms, the locking sleeve configured to slide to partially surround the second of the pair of locking arms when the proximal ends of the pair of locking arms are aligned.

2. The locking device of claim 1, wherein the locking sleeve has a throughhole therein, and wherein the second of the pair of locking arms has a throughhole therein.

3. The locking device of claim 2, wherein the throughhole formed in the locking sleeve and the throughhole in the second of the pair of locking arms are aligned when the locking sleeve is partially surrounding the second of the pair of locking arms.

4. The locking device of claim 2, wherein the throughholes formed in the locking sleeve and the second of the pair of locking arms are configured to receive at least a portion of a lock, wherein the portion of the lock received into the throughholes in the locking sleeve and the second of the pair of locking arms prevents movement of the pair of locking arms relative to each other.

5. The locking device of claim 1, wherein the pair of locking arms have bumpers connected to distal ends thereof.

6. A locking device comprising:

an upper frame;

a lower frame pivotably connected to the upper frame;

an upper arm connected to the upper frame;

a lower arm connected to the lower frame, wherein the lower arm has a different length than the upper arm; and wherein the pivotable connection between the upper frame and the lower frame is configured to allow movement of frame between a first position and a second position, wherein, in the first position, the upper arm and the lower arm are positioned a first distance from one another, and in the second position, the upper arm and the lower arm are positioned a second distance from one another, wherein the second distance is greater than the first distance.

7. The locking device of claim 6 further comprising a locking portion, comprising a first locking mount connected to the lower frame.

8. The locking device of claim 7, wherein the upper frame is formed with a space therein to receive the first locking mount when the locking device is pivoted to the second position.

9. The locking device of claim 8, further comprising a second locking mount which at least partially surrounds the space formed in the upper frame.

10. The locking device of claim 9 wherein the second locking mount has a hole therein, and wherein the holes in the first and second locking mounts are aligned when the locking device is in the second position.

11. The locking device of claim 10 wherein the second locking mount extends normal to the surface of the upper frame and surrounds the space on at least two opposing sides.

12. The locking device of claim 7, wherein the first locking mount has a hole formed therein, the hole configured to receive at least a portion of a lock.

* * * * *